US008671578B1

(12) United States Patent
Frazer

(10) Patent No.: US 8,671,578 B1
(45) Date of Patent: Mar. 18, 2014

(54) FORWARD EXTENDING ASSISTED OPENING KNIFE

(75) Inventor: Spencer Frazer, Lynnwood, WA (US)

(73) Assignee: SOG Specialty Knives and Tools, Lynnwood, WA (US)

( * ) Notice: Subject to any disclaimer, the term of this patent is extended or adjusted under 35 U.S.C. 154(b) by 762 days.

(21) Appl. No.: 12/540,495

(22) Filed: Aug. 13, 2009

Related U.S. Application Data

(60) Provisional application No. 61/088,854, filed on Aug. 14, 2008.

(51) Int. Cl.

| | |
|---|---|
| ***B26B 3/06*** | (2006.01) |
| ***F41B 13/02*** | (2006.01) |
| ***F41C 27/18*** | (2006.01) |
| ***B26B 1/00*** | (2006.01) |

(52) U.S. Cl.
USPC ..... 30/162; 30/151; 30/335

(58) Field of Classification Search
USPC ..... 30/160–163, 151, 153, 155, 255, 335, 30/337
See application file for complete search history.

(56) References Cited

U.S. PATENT DOCUMENTS

| | | | | | |
|---|---|---|---|---|---|
| 472,104 | A | | 4/1892 | Bültzingslöwen | |
| 475,306 | A | | 5/1892 | Franklin | |
| 515,743 | A | | 3/1894 | Bültzingslöwen | |
| 845,792 | A | * | 3/1907 | Jenkins | 30/162 |
| 1,024,749 | A | | 4/1912 | Sjoberg | |
| 1,453,897 | A | | 5/1923 | Vincent | |
| 1,476,123 | A | * | 12/1923 | Watson | 30/161 |
| 1,859,158 | A | | 5/1932 | Pernek | |
| 2,199,430 | A | * | 5/1940 | Greve | 30/160 |
| 2,260,141 | A | | 10/1941 | Hanle | |
| 2,730,800 | A | * | 1/1956 | Bailey | 30/2 |
| 2,793,434 | A | * | 5/1957 | Wigington | 30/151 |
| 4,265,017 | A | | 5/1981 | Collins | |
| 4,442,559 | A | * | 4/1984 | Collins | 7/158 |
| 4,630,373 | A | * | 12/1986 | Staurseth | 30/514 |
| 4,823,463 | A | | 4/1989 | Lemaire | |
| 4,926,555 | A | | 5/1990 | Lemaire | |
| 5,139,507 | A | * | 8/1992 | Dolgin et al. | 606/167 |
| 5,371,948 | A | | 12/1994 | Liffiton | |
| 5,440,814 | A | * | 8/1995 | Hall et al. | 30/295 |
| 5,511,311 | A | | 4/1996 | Collins | |
| 5,716,363 | A | * | 2/1998 | Josephberg | 606/107 |
| 5,769,094 | A | * | 6/1998 | Jenkins et al. | 30/161 |
| 6,059,792 | A | * | 5/2000 | Josephberg | 606/107 |
| 6,085,423 | A | * | 7/2000 | Marifone | 30/162 |
| 6,170,158 | B1 | * | 1/2001 | Daily | 30/161 |
| 6,178,640 | B1 | * | 1/2001 | Votolato | 30/2 |
| 6,643,936 | B2 | * | 11/2003 | Carlson et al. | 30/162 |
| 7,086,158 | B1 | | 8/2006 | Halpern et al. | |
| 7,305,769 | B2 | | 12/2007 | McHenry et al. | |
| 7,562,455 | B2 | * | 7/2009 | McHenry et al. | 30/162 |
| 2003/0079347 | A1 | * | 5/2003 | Davis | 30/2 |
| 2006/0207102 | A1 | | 9/2006 | Bezold et al. | |

* cited by examiner

*Primary Examiner* — Ghassem Alie
*Assistant Examiner* — Bharat C Patel
(74) *Attorney, Agent, or Firm* — Forrest Law Office, P.C.

(57) ABSTRACT

In general, it can be appreciated that the specific type of knife is an "Out the Front" (OTF) knife whereby the blade is operatively configured to reposition longitudinally forwardly with respect to the handle. The handle in general has an interior surface forming an interior chamber. In addition to the handle and blade, the knife further includes a stored energy mechanism. In general, the stored energy mechanism permits the OTF knife to operate with assisted opening technology with a linear-actuating-type system. Described herein are a few embodiments by way of example of the broadly claimed concept, and it can be appreciated that numerous types of assisted opening technologies, such as a stored energy mechanism, can be incorporated.

8 Claims, 14 Drawing Sheets

FORWARD EXTENDING ASSISTED OPENING KNIFE

RELATED APPLICATIONS

This application claims priority benefit of U.S. Ser. No. 61/088,854, filed Aug. 14, 2008.

BACKGROUND OF THE DISCLOSURE

One form of pocket knife has the blade movable with respect to a handle for storage and for general carry. A traditional type of knife is a folding knife wherein the blade is pivotally attached to the handle. Folded knives are very effective and have a plurality of types of assisted opening technologies applied thereto, and further have various types of locking mechanisms to lock the blade open. Folded knives run the liability of having the knife closing upon the fingers of the knife handler. It is well known in the art of folding knives that the sharp edge portion folds towards the handle and towards an interior longitudinal slot to store the blade therein.

Another type of knife is an "Out the Front" (OTF) opening mechanism whereby the blade extends longitudinally forward with respect to the handle so as to provide a forward opening knife.

Certain actuating mechanisms have been employed, such as the OTF knife as described in U.S. Pat. No. 7,305,769. This particular knife has a type of actuating system that allows the blade to be projected forward, and there are two actuators on either side of the blade whereby stored energy upon an activating switch provides a forward thrust and a rearward thrust.

Switchblade knives are well-known in the art of knives whereby stored energy by way of a spring or other type of spring-like mechanism is utilized to accelerate a blade open, such as with the folding type of knife design. Switchblades are a controlled type of mechanism within most jurisdictions. In general, a switchblade will have some type of an actuator, such as a button, which can have an internal seer-like mechanism to release the stored energy to rotate a blade open.

Assisted opening technologies have been utilized for certain types of folding blades. In general, an assisted opening technology is not a controlled mechanism but rather the user actually imparts a force directly to the blade to provide an opening force thereupon. Assisted technology in swingable foldable knives is a term that signifies that an operator has to manually move the blade a certain predetermined amount in order for a spring and or mechanism to help in propelling it to its fully extended position. This has never been done before in OTF type knives.

DETAILED DESCRIPTION

Figures 1, 2, 3, 4:
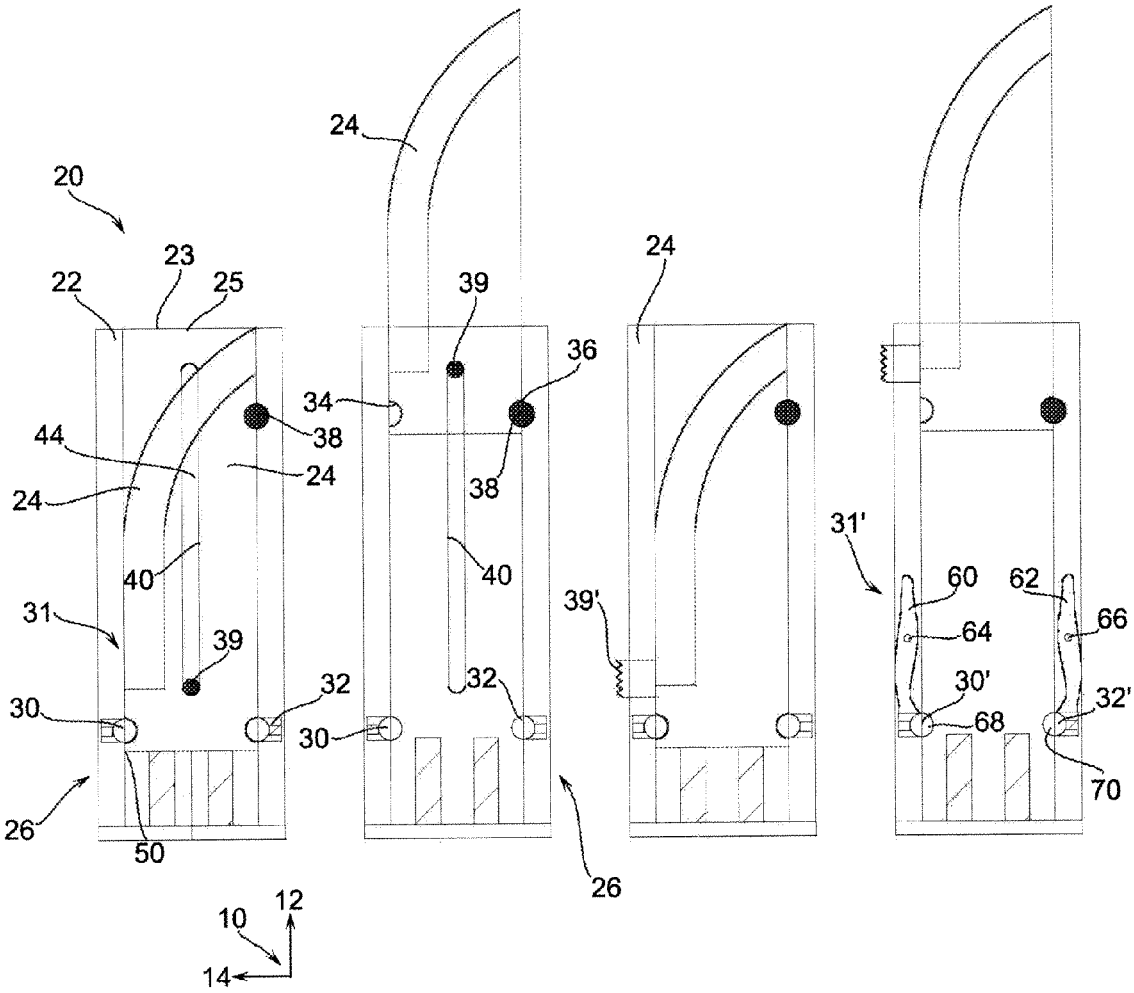
FIG. 1 shows a side view of a first embodiment of an OTF knife with the blade in a retracted position.
FIG. 2 shows the blade of FIG. 1 in an extended position.
FIG. 3 shows another embodiment where the knife handler engagement portion is positioned in a transverse region of the handle.
FIG. 4 shows a different type of a blade retaining system.

As shown in FIG. 1, there is a knife 20 having a handle 22 and a blade 24. To aid in the description of the drawings, and axes system is defined shown at 10 where the axis 12 indicates a longitudinal direction pointing in a longitudinally forward orientation, and the axis 14 indicates a transverse direction wherein the axis orthogonal to 12 and 14 is a lateral direction.

In general, it can be appreciated that the specific type of knife is an "Out the Front" (OTF) knife whereby the blade 24 is operatively configured to reposition longitudinally forwardly with respect to the handle 22. The handle in general has an interior surface 23 forming an interior chamber 25 as shown in FIG. 1.

In addition to the handle and blade 22 and 24, the knife 20 further comprises a stored energy mechanism 26. In general, the stored energy mechanism 26 enables the OTF knife to operate with assisted opening technology with a linear-actuating-type system. Shown herein are a few embodiments by way of example of the broadly claimed concept, and of course it can be appreciated that numerous types of assisted opening technologies, such as a stored energy mechanism, can be incorporated.

As shown in FIG. 1, there is a blade-retaining system 31, which in one form is comprised of first and second retaining members 30 and 32. The retaining members 30 and 32 are operatively configured to engage the retention notches (portions) 34 and 36 as shown in FIG. 2 of the blade 24. In general, the first and second retaining members 30 and 32 are operatively configured to be springingly attached to the handle 22 so as to reposition in the transverse outward direction with respect to a center longitudinal axis of the handle 22. Further, a lock 38 can be employed which is attached to the handle and configured to engage, for example, the second retaining notch 36 as shown in FIG. 2 to lock the blade 24 in the extended position where the blade is positioned in a longitudinally forward location with respect to the handle 22. As further shown in FIGS. 1 and 2, it can be appreciated that there is a knife-handling engagement portion 39. In general, the knife-handling engagement portion 39 can be a laterally extending notch extending through the surface defining the longitudinal slot 40 of the handle 22. In other forms, the knife-handling engagement portion can be in a longitudinally forward region, for example at the area indicated at 44 of the blade 24. Having the knife handler engagement portion in a more forward location is advantageous because the knife handler can use his or her thumb to impart a longitudinally forward force on the blade, which is sufficient to overcome the retaining force of the retaining members 30 and 32.

At this juncture, there will be a description of the operation of the OTF knife utilizing a stored energy mechanism. An additional component of the stored energy mechanism 26 includes a biasing member, which in one form will generally be positioned at the location 50 of the handle 22. In general, the biasing member in one form could be a helical spring or other type of mechanism. Therefore, it can be appreciated that when the blade 24 is in a retracted stored position as shown in FIG. 1, the biasing member of the stored energy mechanism 26 is in a high-energy state, but the force of the blade-retaining system 31 which in one form comprises the first and second retaining members 30 and 32 is sufficient to keep the blade 24 stored within the interior/central chamber 25 of the handle 22. It can be appreciated that when the knife handler provides a force directly upon the blade 24 in a longitudinally forward direction, there is an additional longitudinally forward force component which effectively acts upon the blade retaining system 31. As the longitudinally forward force is applied to the blade, in one form the first and second retaining members 30 and 32 will reposition transversely outward and disengage the retaining notches 34 and 36. Thereafter, the biasing member which is located approximately at position 50 would spring the blade to the longitudinally forward location as shown in FIG. 2.

As shown in FIGS. 3 and 4, there is another embodiment where the knife-handling engagement portion 39' is positioned on a first transverse portion of the handle 24. As shown in FIG. 4, it can be appreciated that the first and second retaining members 30' and 32' comprise a different type of blade-retaining system 31'. In this form, these retaining members can, for example, be pivotally attached to the lever arms 60 and 62, which in one form are pivotally attached at the pivot attachment locations 64 and 66 and some form of a spring acting thereupon biases the actual blade engagement portions 68 and 70

Figure 7:
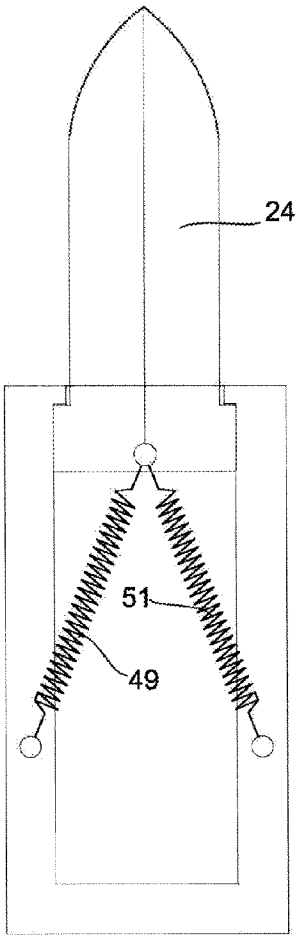
FIG. 7 shows the blade of FIG. 5 in an extended orientation.
Figure 6:
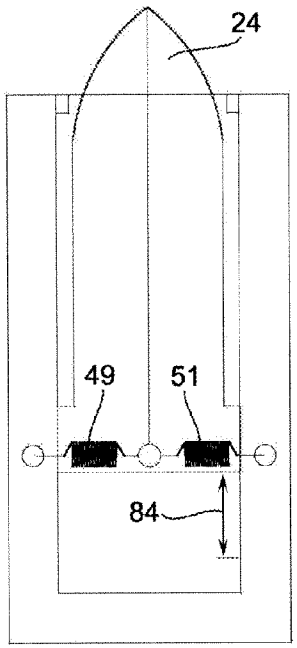
FIG. 6 shows the embodiment of FIG. 5 with the blade at a prescribed forward distance where the blade retention system is at a maximum store energy state.
Figure 5:
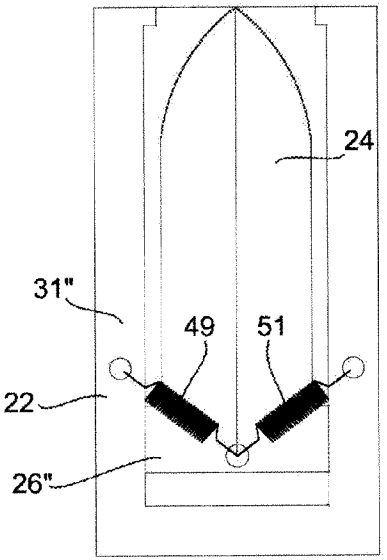
FIG. 5 shows another embodiment of an OTF knife.

As shown in FIG. 5, there is another type of blade retaining system 31" which is integral with the store energy mechanism 26". In general, the first and second biasing members 49 and 51 are attached to the handle 22 and further attached to the blade 24. The blade is in a retained position where the biasing members 49 and 51 in this form are schematically shown as compressive-type springs. It can be appreciated that they are in a high energy state in the stored position. As shown in FIG. 6, the members 49 and 51 are in a yet higher stored energy state whereby the blade 24 has moved in a longitudinally forward location a prescribed distance, which is generally shown at 84. This prescribed distance can be designed for proper ergonomics with respect to the user/knife handler, and it can be appreciated that the movement of the blade 24 occurs by having a longitudinally forward force component placed thereupon. FIGS. 5 and 6 illustrate the general principle of an assisted opening OTF knife where the spring members/biasing members 49 and 51 operate to have additional stored energy therein to get past the prescribed distance 84, and thereafter, the blade 24 will spring to an open position such as that shown in FIG. 7. Again, it should be reiterated that FIG. 7 is somewhat schematic, and the biasing members 49 and 51 are compressive-type springs in one form.

Figure 8:
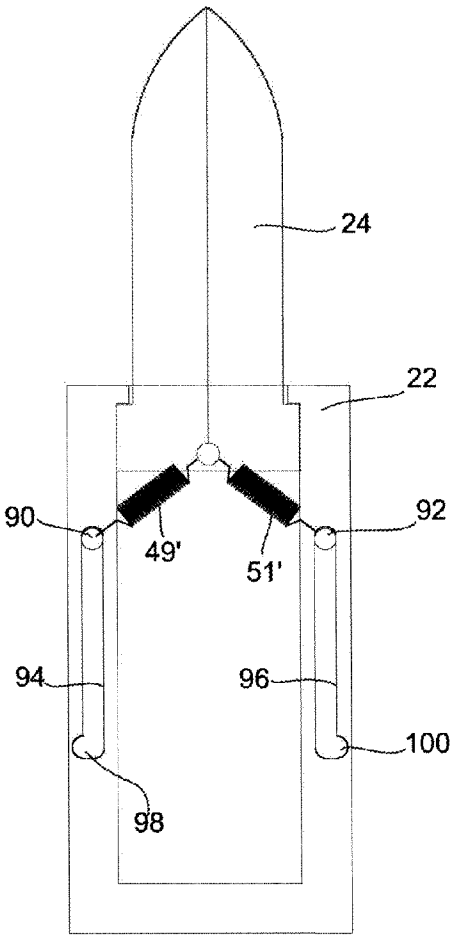
FIG. 8 shows another embodiment of the embodiment shown in FIGS. 5-7.

As shown in FIG. 8, it can be shown how the biasing members 49' and 51' are configured to have base mount regions 90 and 92, which is operatively configured to longitudinally reposition along the handle 22. In this form, the surface defining the slots 94 and 96 have catch regions 98 and 100. Present analysis indicates that having the base mount regions 90 and 92 engage the catch regions 98 and 100 when the blade 24 is at a retained position can provide a sufficient amount of resistance to provide further stored energy within the biasing members 49' and 51'. FIG. 8 is a highly schematic drawing, whereby the general principle of having a movable base mount region or other type of repositionable attachment location of the biasing member can be employed to provide, in general, an initial springing force upon the blade 24, and thereafter let the blade "coast" or otherwise use its momentum and inertia to spring forward to the extended position.

Figures 9, 10:
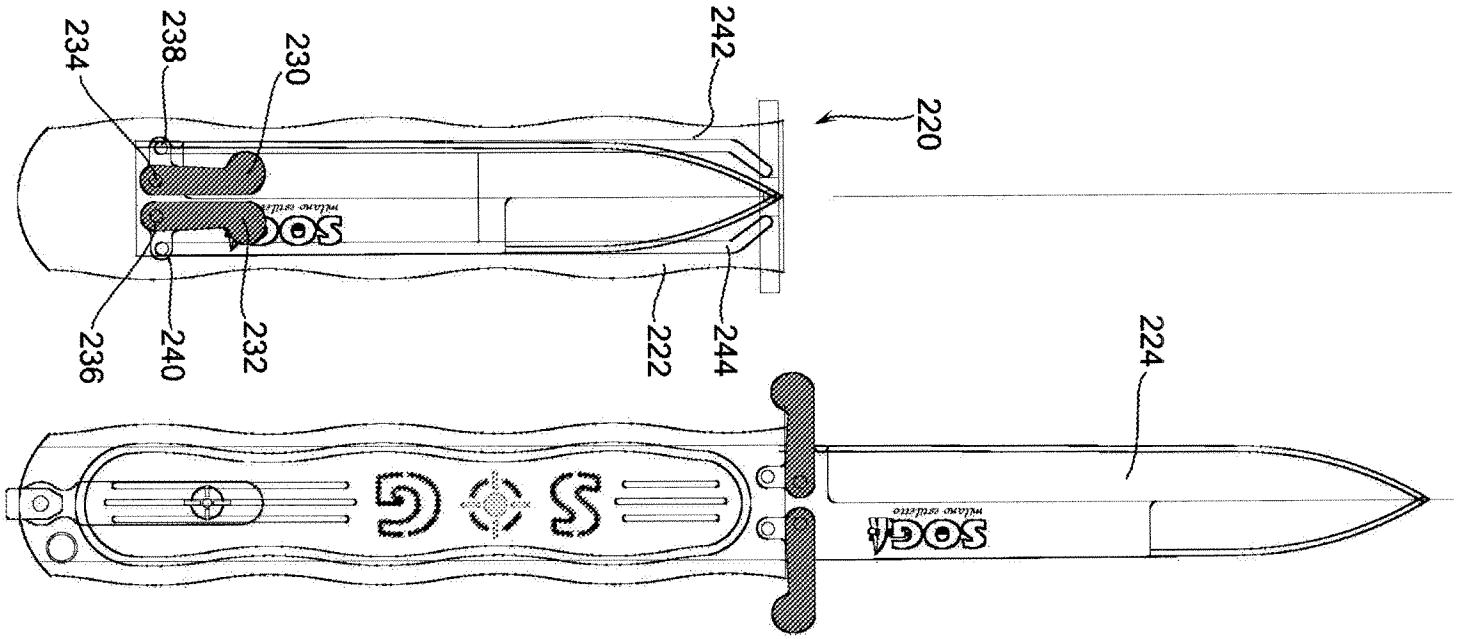
FIGS. 9-12 show another embodiment having cross-guard members protrude out from a forward portion of the handle to an extended orientation.
Figure 11:
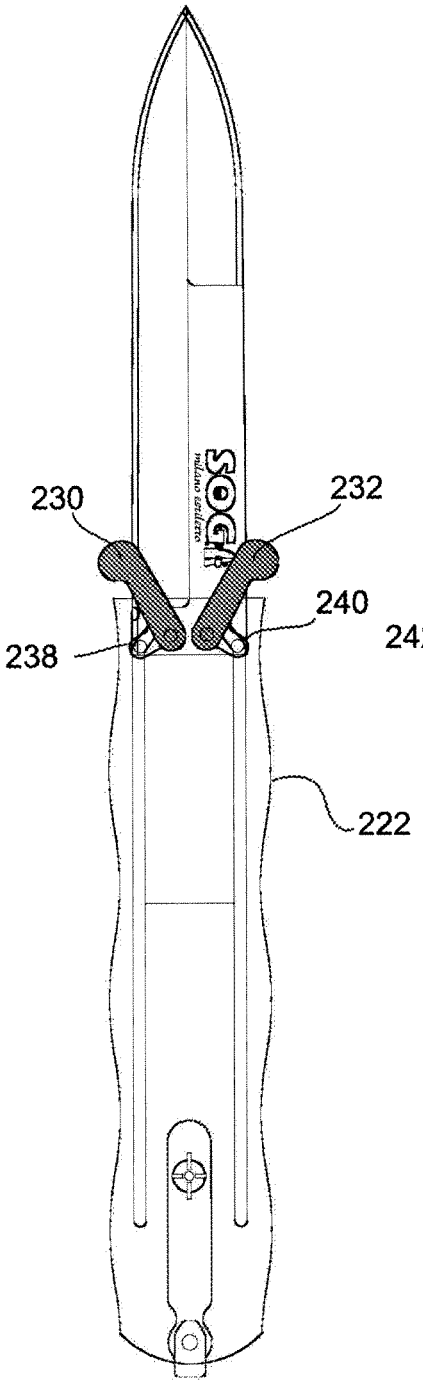
Figure 12:
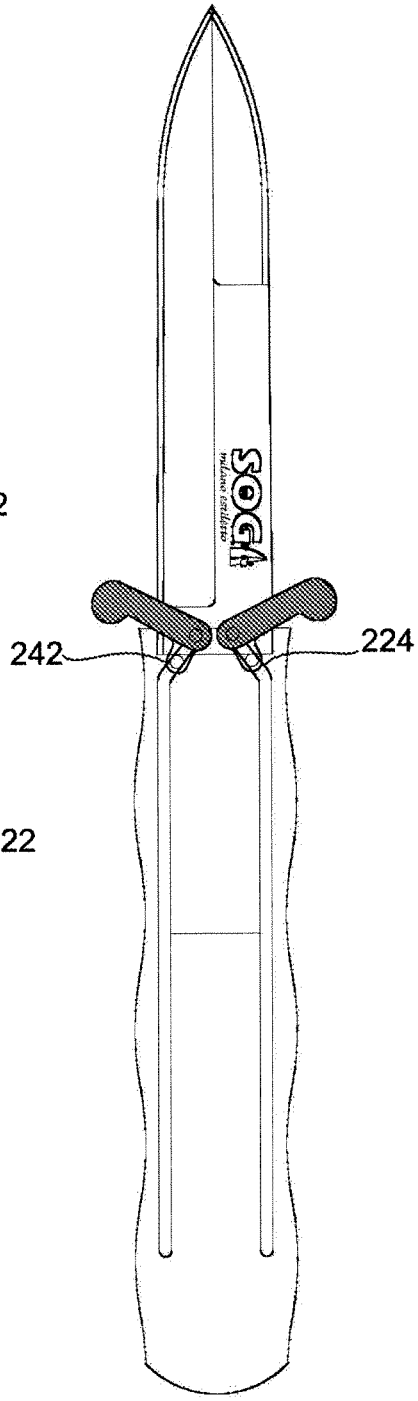

As shown in FIGS. 9 and 10, there is shown another embodiment 220. In this form, first and second cross-guard members 230 and 232 are provided. In general, the cross-guard members are pivotally attached to the blade at the pivot attachment locations 234 and 236, and further are repositionably attached to the handle by way of the extensions 238 and 240. In general, the extensions 238 and 240 are operatively configured to track along the surface defining the slots 242 and 244 within the handle 222. As shown in FIG. 10, the blade 224 is in an extended orientation. FIG. 11 shows the blade in an almost-extended orientation where it can be appreciated that the extensions 238 and 240, which are attached to the cross-guard members 230 and 232 are just about to engage the longitudinally forward region of the slots 242 and 244. As shown in FIG. 12, it can be appreciated that as the extensions 238 and 240 are effectively rotated counterclockwise and clockwise respectively, this produces an opening force upon each of the cross-guard members. It can be appreciated in FIG. 9 that the cross-guard members 230 and 232 are retained within the housing of the handle 222.

It should be noted that out-the-front-style knives having a blade which slides out to an extended position are well known in the art. This style of knives can be much safer in some instances, as the user does not need to exert force upon the blade portion to extend or retract the blade, thus both transverse edges of the blade may be sharpened to a cutting edge. It is may also be desired to protect the user's hand from accidental cutting by way of cross guards. These cross guards are normally often permanently affixed to the handle extending such that the user's hand is substantially prohibited from sliding down the handle on to the blade portion of the knife. U.S. Pat. No. 845,792 invented by one L. E. Jenkins and filed in 1906 discloses a knife having a plurality of cross guards which are pivotally (using a pivot) coupled to the handle and extend as the blade is extracted therefrom. The applicant has invented and herein disclosed a knife wherein a plurality of cross guards may be pivotally attached to the blade, and extend as the blade is extracted from the handle, but are contained within the handle while the blade is retracted. This allows for cross guards having a more utilitarian shape, more functionality, and a cleaner operation.

Figure 14:
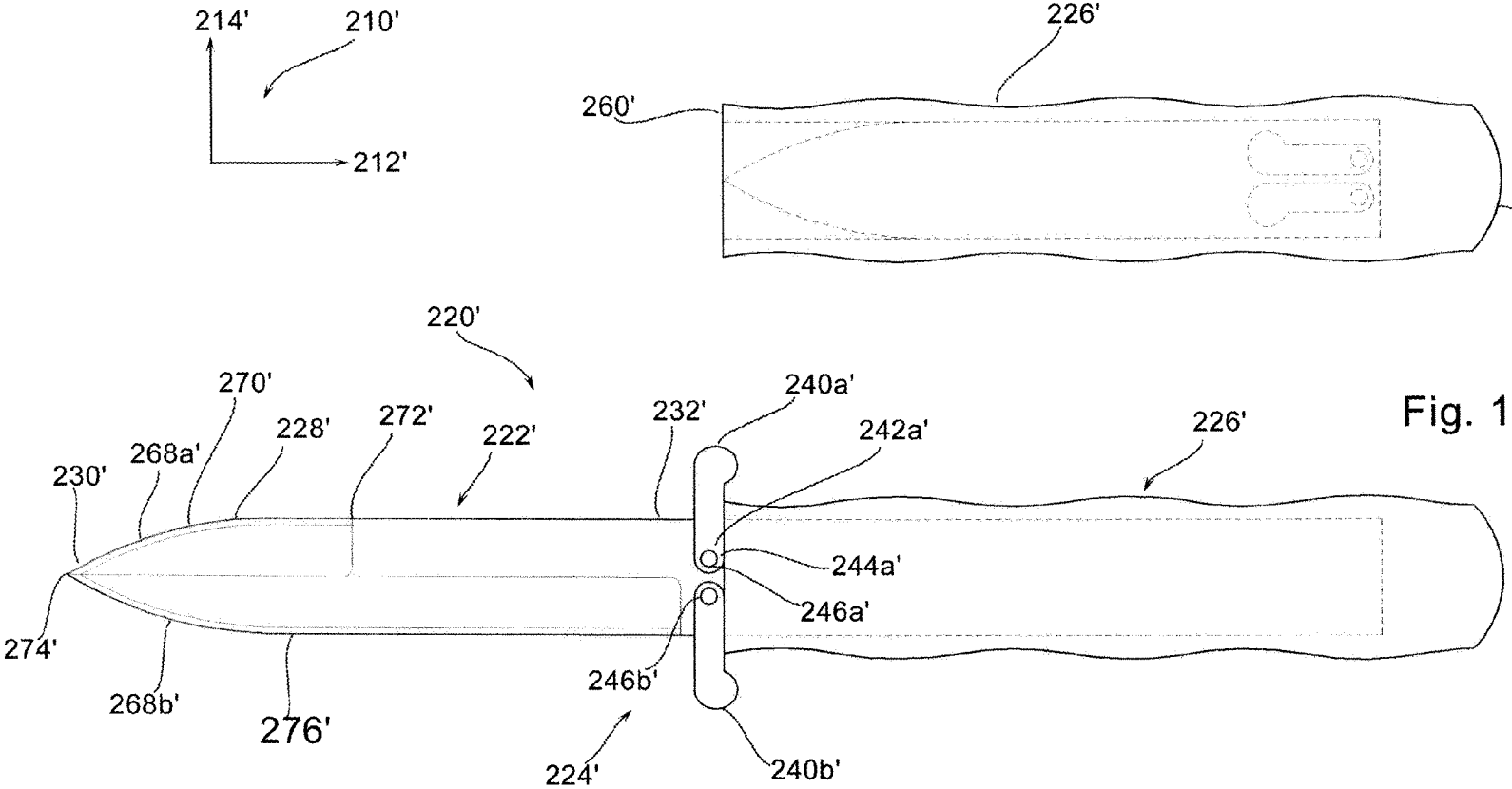
FIG. 14 is a hidden line plan view of one embodiment in an extended orientation.

The three major elements of the embodiment of the knife 220' are shown in FIG. 14 being a blade assembly 222', a cross guard assembly 224', and a handle assembly 226'. The blade assembly 222' comprises a blade 228' having a first end 230', which may be a point, and a second end 232' which generally engages the cross guard assembly 224' and the handle assembly 226'.

The cross guard assembly 224' comprises a first cross guard 240*a*' and a second cross guard 240*b*'. The first cross guard 240*a*' includes a first cross guard pivot 242*a*' comprising a void 244*a*' and a pin 246*a*'. The pin 246*a*' passes through the void 244*a*' and into a void within the blade assembly 222' to form a pivot point about which the first cross guard 248' pivots in relation to the blade assembly 222'.

Figure 13:
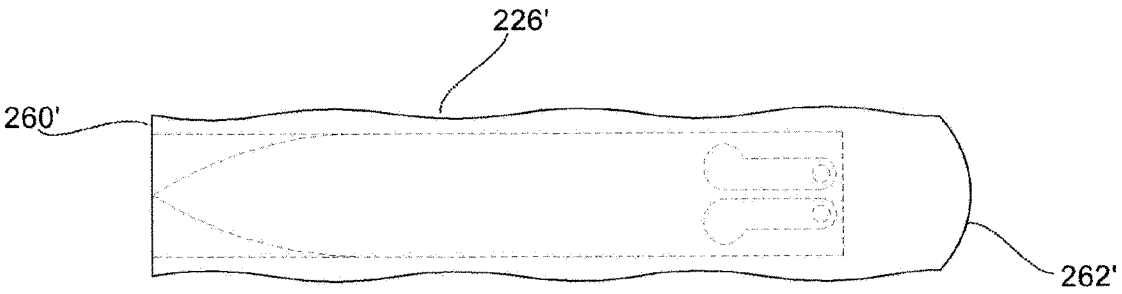
FIG. 13 is a hidden line plan view of one embodiment in a sheathed orientation.
Figure 17:
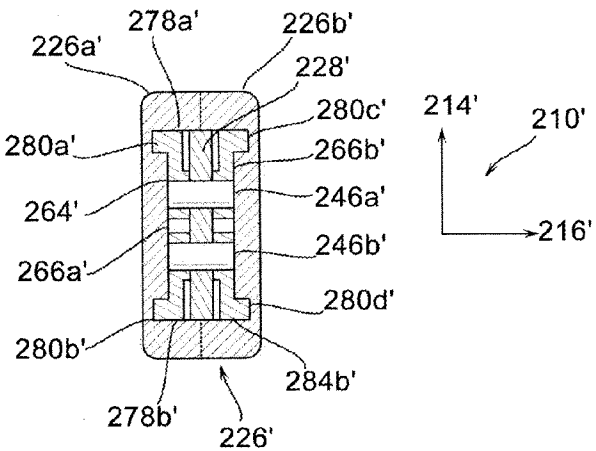
FIG. 17 is a cutaway view of one embodiment taken along line 5-5 of FIG. 3.
Figure 16:
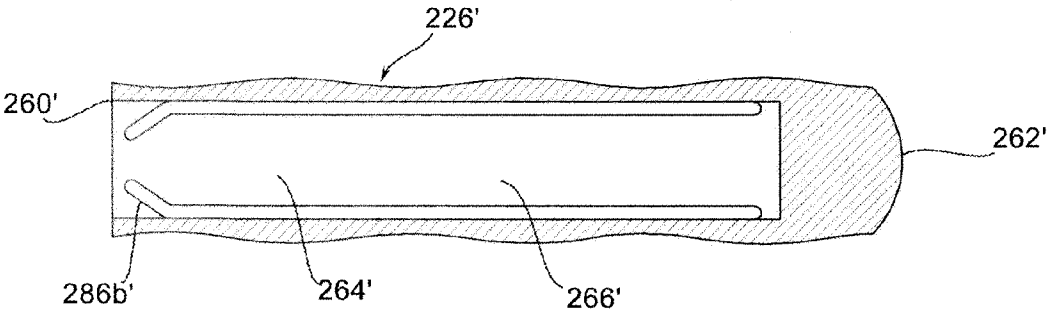
FIG. 16 is a cutaway plan view of the handle assembly of one embodiment.

The handle assembly 226' as shown in FIG. 13 comprises a blade end 260' and a butt end 262'. Looking to FIG. 16, which is a cross-section of the handle assembly 226', it can be seen how a blade channel 264' is disposed within the handle assembly 226'. As the handle assembly 226' as shown in FIG. 17 may comprise a first half portion 226*a*' and a second half portion 226*b*'. It can be seen how the blade channel 264' consists of a plurality of surfaces including a plurality of lateral interior surfaces 266' shown in FIG. 16, including a first lateral interior surface 266*a*' at and a second lateral interior surface 266*b*' as shown in FIG. 17. The handle assembly 226' further provides a first transverse surface 278*a*' and a second transverse surface 278*b*'. The handle assembly 226' also provides a plurality of pivot channels 280*a*' and 280*b*'. In one form, these pivot channels are mirrored on the lateral opposite side as pivot channels 280*c*' and 280*d*'. The blade 228' further includes a first lateral side 296*a*' and a second lateral side 296*b*'.

The blade assembly 222' as shown in FIG. 14 comprises a blade 228' having a first transverse side 268*a*' and a second transverse side 268*b*'. The first transverse side 268*a*' in one form includes a sharpened portion 270' from a transition point 272' to the tip 274' at the termination of the first end 230' of the blade. The second transverse side 268*b*' in one form has a sharpened portion 276' extending a substantial portion of the second transverse side 268*b*'. The blade assembly 222' further comprises a plurality of voids configured to engage the pins 246*a*' and 246*b*'.

Figure 19:
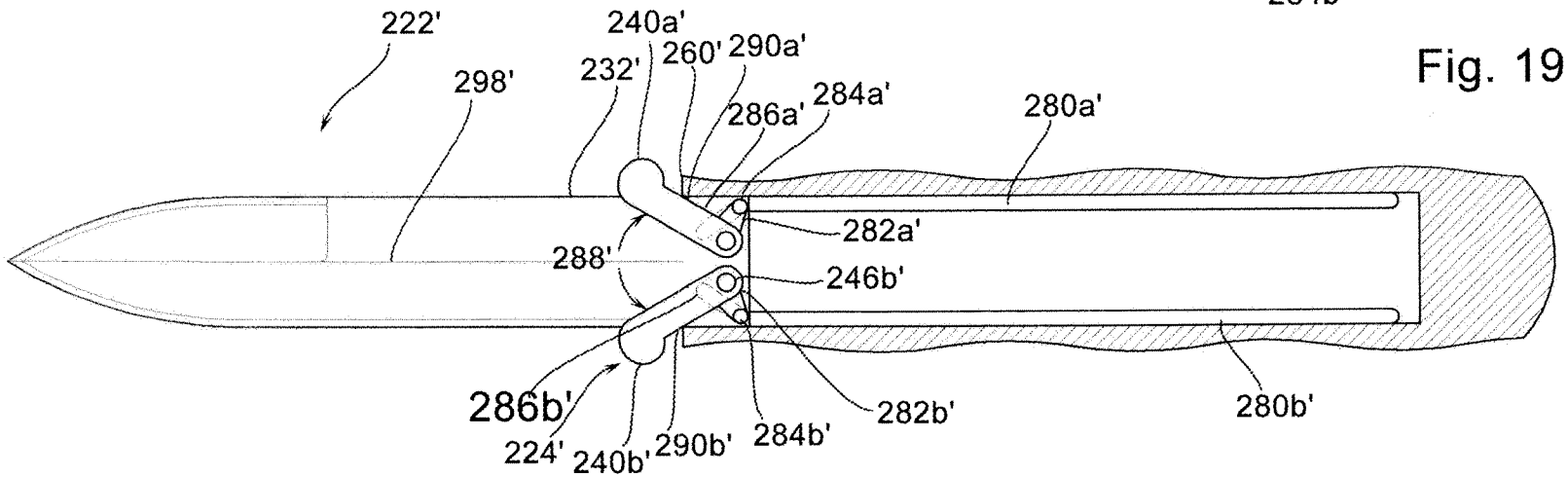
FIG. 19 is a cutaway plan view of one embodiment in a substantially extended orientation.

Referring now to FIG. 19, the cross guard assembly 224' can be seen in more detail. The second cross guard 240*b*' is pivotally attached to the blade assembly 222' by way of the pin 246*b*' as previously discussed. Extending from the second cross guard 240*b*' is a wing 282*b*' having a first end attached to the second cross guard 240*b*' and a second end substantially terminating in a sliding pin 284*b*'. Looking at FIG. 17, it must be kept in mind that in one embodiment, there are opposing pivot channels 280*b*' and 280*d*'. Thus while you are looking at pivot channel 280*b*' in FIG. 19, the sliding pin 284*b*' will extend laterally and slide within pivot channel 280*bd*'. An opposing sliding pin (not shown) could be configured to engage the sliding channel 280*b*'. Looking to FIG. 17, it can be seen how the sliding pin 284*b*' is engaged within the channel 280*b*'. Looking back to FIG. 19, the wing 282*b*' may be attached to the second cross guard 240*b*', or could alternatively be formed as a unitary structure. For ease of explanation and understanding henceforth the apparatus 220' will be described as if the sliding pins 284*a*' and 284*b*' engage the channels 280*a*' and 280*b*'. It is important to remember that during construction this is not the case as has previously discussed but that the sliding pins 284*a*' and 284*b*' in one form engage the channels 280*c*' and 280*d*'.

Figure 15:
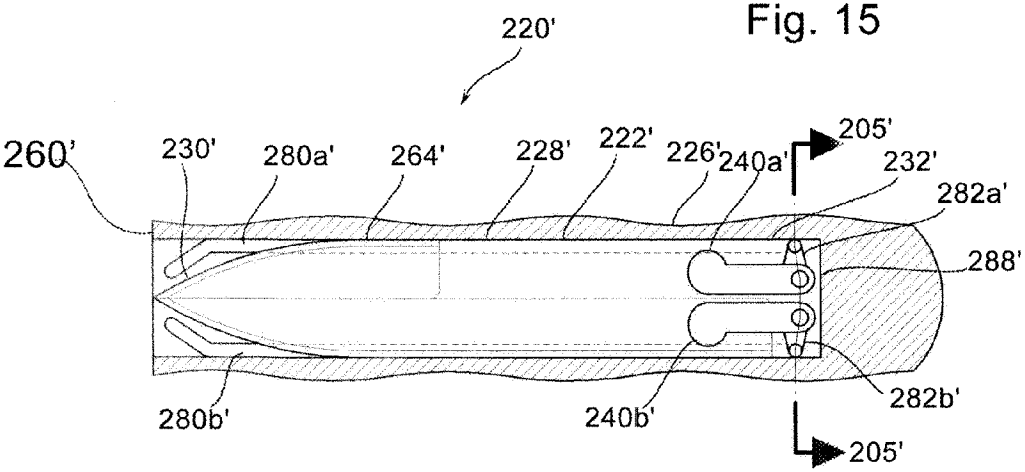
FIG. 15 is a cutaway plan view of one embodiment in a sheathed orientation.
Figure 18:
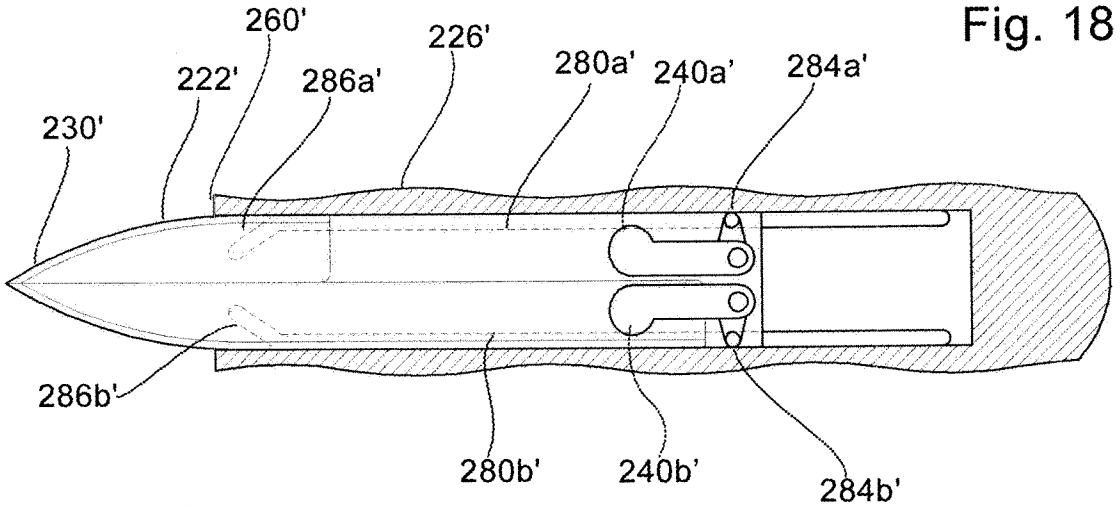
FIG. 18 is a cutaway plan view of one embodiment in a partially extended orientation.
Figure 20:
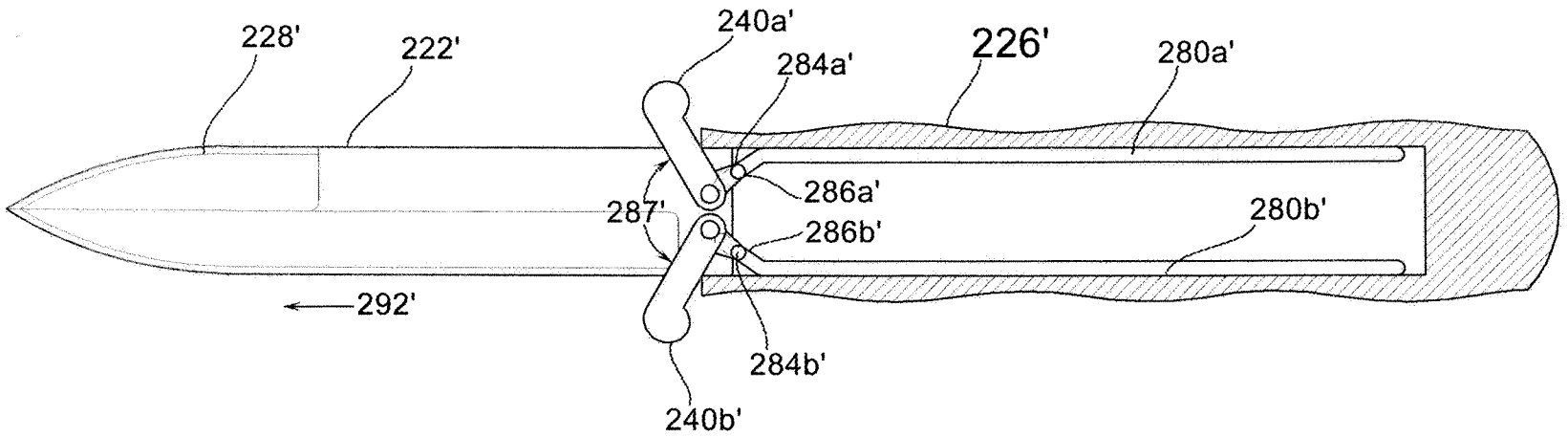
FIG. 20 is a cutaway plan view of one embodiment in a nearly fully extended orientation.
Figure 21:
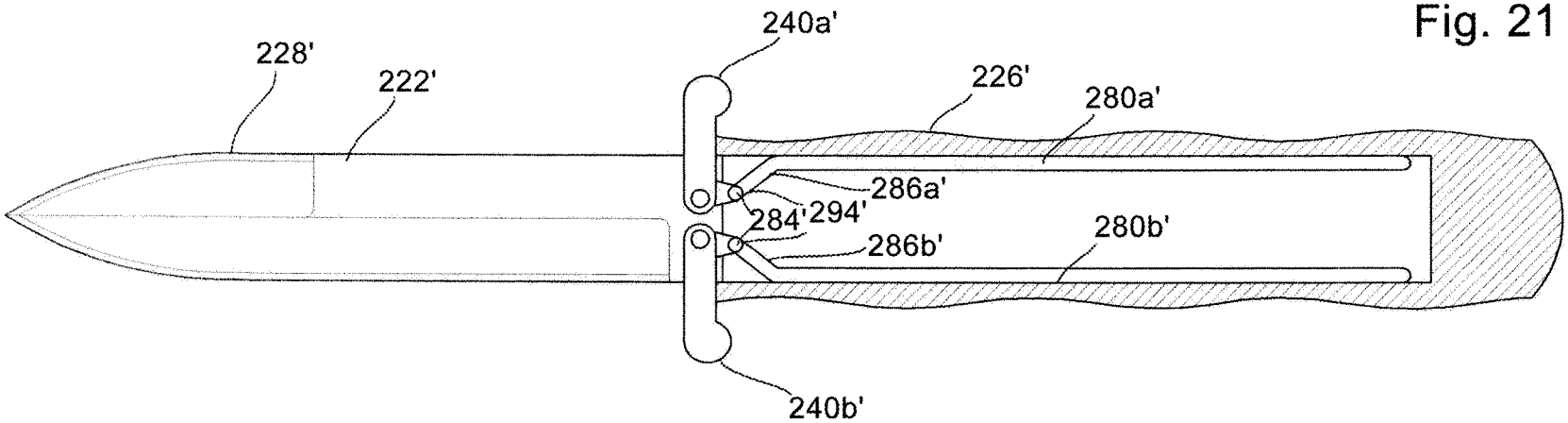
FIG. 21 is a cutaway plan view of one embodiment in a fully extended orientation.

A sequence will now be explained wherein as the blade assembly is extended from the handle of the knife, the cross guard assembly extends from the interior portion of the handle to an extended position. FIG. 15 shows the knife 220' in a sheathed position wherein the blade assembly 222' is housed substantially within the handle assembly 226'. As can be seen, the second end 232' of the blade abuts against the butt end 288' of the blade channel 264' in one form. The first cross guard 240*a*' and second cross guard 240*b*' are substantially parallel to one another, and the wings 282*b*' and 282*a*' are substantially perpendicular to the longitudinal axis of the blade 228'. As the blade is released either by gravity, centrifugal force, spring action, or other methods, the first end 230' of the blade 228' extends from the blade end 260' of the handle assembly 226' as depicted in FIG. 18. As the sliding pins 284*a*' and 284*b*' have not yet reached the angled portions 286*a*' and 286*b*' of the pivot channels 280*a*' and 280*b*', the cross guard 240*a*' and 240*b*' are in the same orientation as they were in FIG. 15. Now looking to FIG. 19, the sliding pins 284*a*' and 284*b*' have reached the angled portion 286*a*' and 286*b*' of the pivot channels 280*a*' and 280*b*'. It can be seen how at least a portion of the cross guards 240*a*' and 240*b*' have extended past the blade end 260' of the handle and thus are in a position to rotate outward as shown by the arrows 288'. As the cross guards 240*a*' and 240*b*' pivot outwardly, they may engage the handle engagement points 290*a*' and 290*b*'. Now looking to FIG. 20, it can be seen how the sliding pins 284*a*' and 284*b*' have traveled down approximately half of the angled portions 286*a*' and 286*b*' of the pivot channels 280*a*' and 280*b*', and the cross guards 240*a*' and 240*b*' have extended further outwardly along the transverse directions of travel 287'. This repositioning of the cross guards 240*a*' and 240*b*' continues as the blade assembly 228' extends from the handle assembly 226' along directions of travel 292'. Looking now to FIG. 21, it can be seen how the blade assembly 228' is fully extended from the handle assembly 226' and the cross guards 240*a*' and 240*b*' have extended roughly perpendicular to the longitudinal axis of the blade 228'. It can also be seen in FIG. 21 how the sliding pins 284' have reached the terminus 294' of the angled portions 286*a*' and 286*b*' of the pivot channels 280*a*' and 280*b*'.

In another embodiment (not shown), a plurality of spring-like members could be interposed between the cross guards and the blade to tension the cross guards against the first transverse surface 278*b*' and the second transverse surface 278*b*'. While these springs are not shown, they could function to increase operative ability of the previous embodiment or could alternatively be utilized in an embodiment wherein the wings 282*a*' and 282*b*' including the sliding pins 284*a*' and 284*b*' are omitted. In this embodiment, the pivot channels 280*a*' and 280*b*' and associated structures could be omitted. Thus as the blade 228' is retracted back into the blade channel 264', the first cross guard 240*a*' would engage the handle engagement point 290*a*' and would tend to reposition it toward the transverse center 298' of the blade 228' as shown in FIG. 19. Likewise, the second cross guard 240*b*' would engage the engagement point 290*b*' and reposition toward the transverse center 298' of the blade 228'. In this embodiment, as the blade further retracted into the blade channel 264', the cross guards would engage the transverse surfaces 278*a*' and 278*b*'.

Figure 21A:
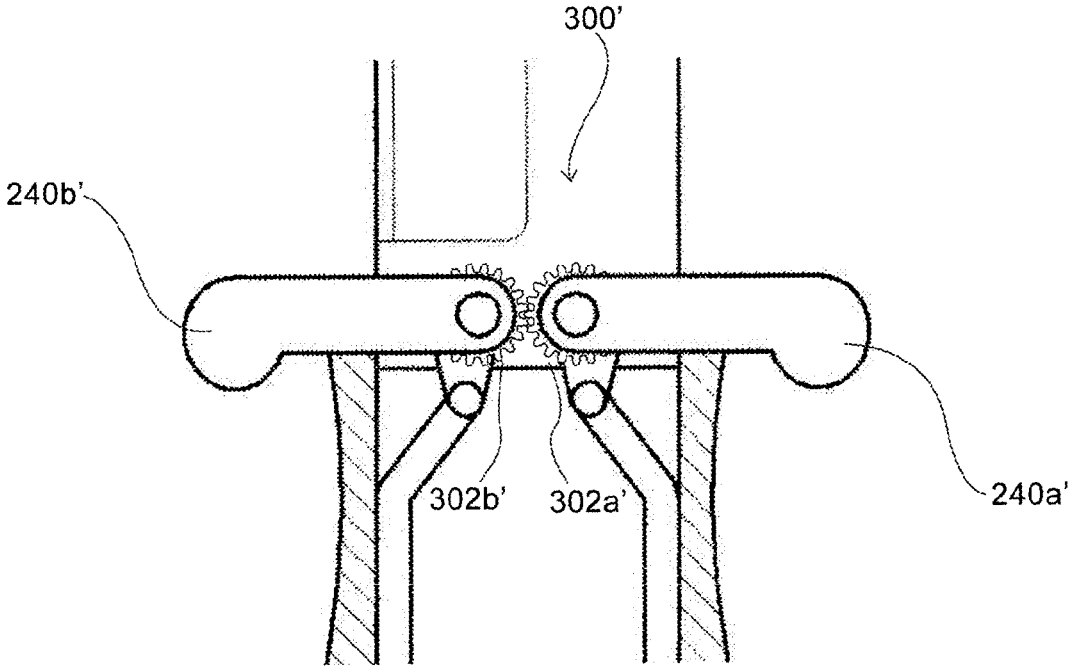

To facilitate the first and second cross guard members 240*a*' and 240*b*' of FIG. 21A operating simultaneously, a geared mechanism 300' could be utilized. The geared mechanism 300' incorporates a plurality of interdigitating members wherein a first interdigitating member 302*a*' is coupled to or formed as part of the first cross guard member 240*a*' and a second interdigitating member 302*b*' is coupled to or formed as part of the second cross guard member 240*b*'. Applicant's U.S. Pat. No. 5,809,599, which is incorporated herein by reference, utilizes this technology. Alternatively, another apparatus could be incorporated such as a belt-like member. These would increase the functionality of the cross guard members and the knife in general, and could be utilized with or possibly without the pivot channels.

As shown in FIGS. 22-26 there is another embodiment of an OTF assisted opening knife that can be used as shown or in conjunction with the extendable cross guard assembly shown above. In general, the assisted opening OTF knife operates on the concept of having an initial resistance force that reaches an equilibrium point with an opening force, whereby after a prescribed amount of forward travel of the blade the opening force overcomes the resistance force to bias the blade longitudinally forwardly to an open position. In FIGS. 22-26, one type of embodiment is shown embracing the above broad apparatus concept.

Figure 22:
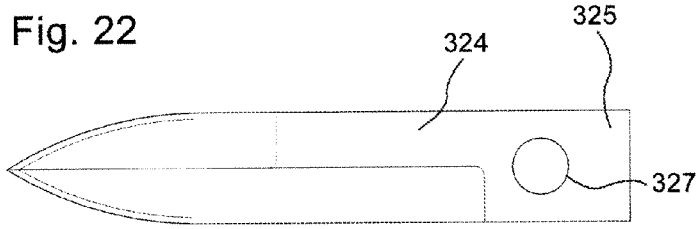
FIG. 22 shows a blade of an additional embodiment.

FIG. 22 shows a blade 324 having a base region 325. Positioned on the base region 325 is a spring engagement member 327, which in one form can be a laterally extending member, such as a laterally extending cylindrical shaped member.

Figure 23:
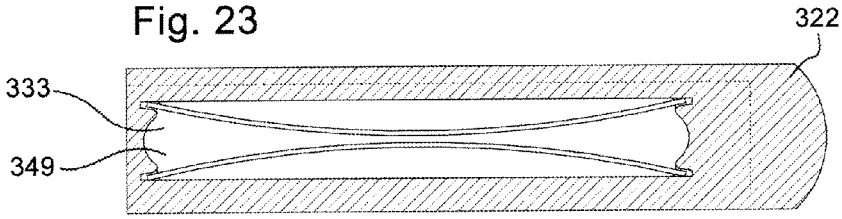
FIG. 23 shows a handle having a leaf spring design to comprise a portion of the spring system.
Figure 24:
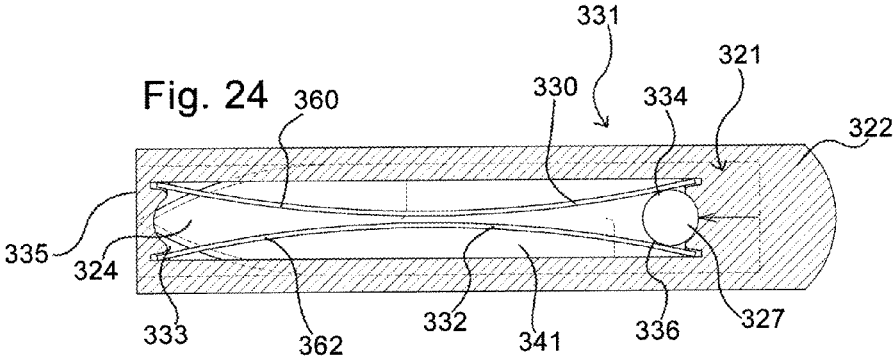
FIG. 24 shows the blade and handle of FIGS. 22 and 23 assembled, where the blade is in a longitudinally rearward orientation.

As shown in FIG. 23, there is a handle 322. The handle has an interior surface 349 which defines a central chamber 333. The blade 324 is optimally configured to be housed within the central chamber 333, as shown in FIG. 24. The handle 322 further comprises a surface defining an opening 335, where as shown in FIG. 25 the blade 324 is configured to extend therethrough the surface defining the opening 335.

With the foregoing description in place, there will now be a discussion of the assisted actuating system 321. In general, the assisted actuating system includes a spring system 341, which is operatively configured to provide a longitudinally rearward force upon the blade when the blade is in a longitudinally rearward orientation, as shown in FIG. 24. The spring system is further configured to provide a longitudinal forward force upon the blade after the blade has passed an equilibrium point, as shown in FIG. 25, where FIG. 26 shows the blade in an open position where the blade is in a longitudinally forward orientation with respect to the handle 322. It can generally be seen that the spring system 341 provides a longitudinally forward force after passing through the equilibrium point 361 shown in FIG. 25.

In one form, shown in FIG. 24, the spring system 341 comprises a blade retaining system 331 where the leaf springs 360 and 362 comprise a longitudinally rearward portion that operates as retaining members 330 and 332. The retaining members 330 and 332 are configured to engage the longitudinally forward retention portions 334 and 336 of the spring engaging member 327. Of course, in the broader scope, one leaf spring can be utilized and other types of biasing members other than the leaf spring can be employed.

Figure 25:
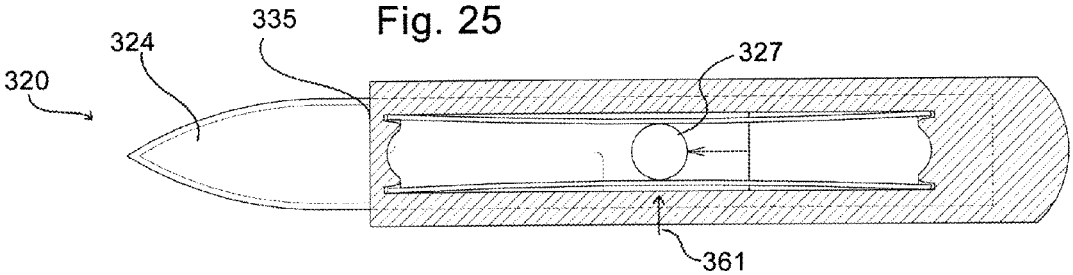
FIG. 25 shows a blade at an equilibrium point.
Figure 26:
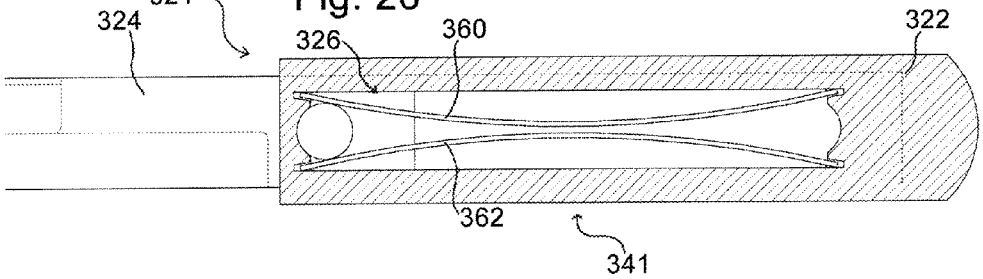
FIG. 26 shows the blade in an extended orientation.

Now referring to FIG. 25, it can be appreciated that the state of the knife 320 is at an equilibrium point, whereby the blade 324 has balanced longitudinal forces thereupon. In other words, the equilibrium point indicated by the position 361 has balanced forces acting upon the blade, in this format the spring engagement member 327. The embodiment, as shown in FIGS. 22-26, applies force to the blade by way of a component of a vector acting upon the blade in the longitudinal rearward or forward direction. At the equilibrium point, these components are neutral, or in one form the longitudinal forces are substantially canceled out or zeroed.

It can be appreciated in FIG. 26 that the leaf springs 360 and 362, which are part of the spring system 341, operate as a stored energy mechanism 326.

Figure 27:
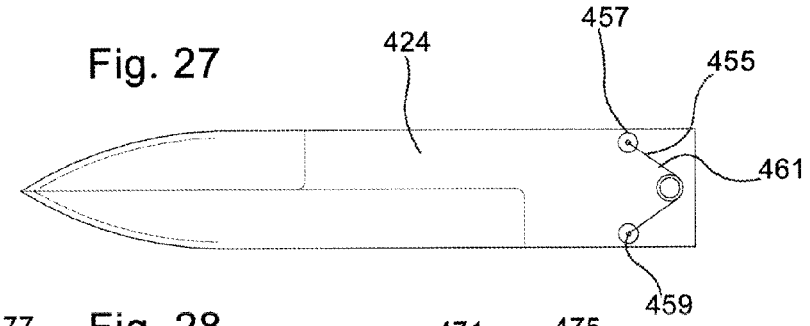
FIG. 27 shows a blade of another embodiment, having a spring element with cam engaging members.
Figure 28:
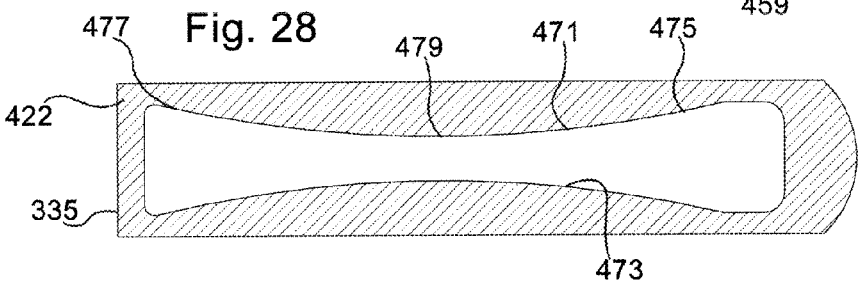
FIG. 28 shows a handle having at least one cam surface configured to engage at least one cam engaging member of the blade.
Figure 29:
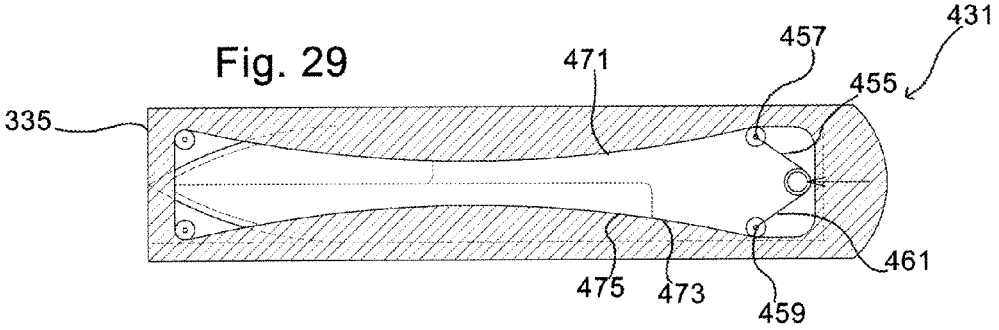
FIG. 29 shows the blade assembled and positioned within a central chamber of the handle when the blade is in a closed orientation.
Figure 30:
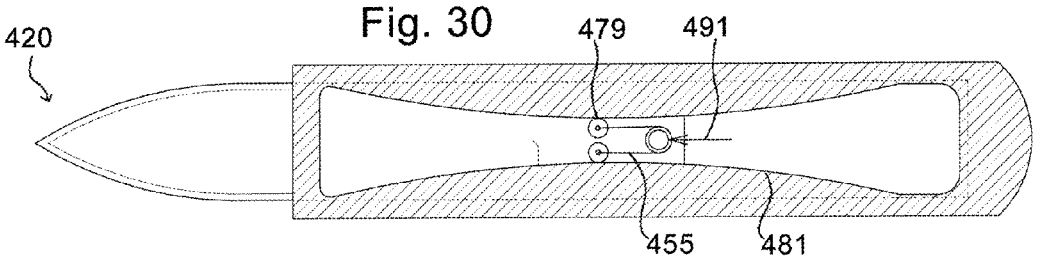
FIG. 30 shows the blade position at an equilibrium point, where the cam engaging members supply substantially orthogonal force to the cam surfaces.

Now referring to FIGS. 27-31, there is shown in another embodiment where there is a knife 420 as shown in FIG. 30. FIG. 27 shows the blade 424, where in FIG. 29 the spring system 431 is shown. FIG. 27 shows a spring element 455 which comprises a first cam engaging member 457 and a second cam engaging member 459. A biasing member 461 is provided, which can be any type of biasing member to bias either or both of the first and second cam engaging members 457 and 459 toward the cam surfaces 471 and 473. As shown in FIG. 28, there is a handle 422, which also has a surface defining the opening 335 as described above to allow the blade to pass therethrough. The handle 422 comprises first and second cam surfaces 471 and 473. In general, each of the cam surfaces comprise a blade retention portion 475 and a blade propulsion portion 477. Interposed between the portions 475 and 477 is an equilibrium point 479, which in one form operates on the principle of providing a surface portion that is substantially orthogonal to the line of thrust upon the cam engaging members 457 and/or 459.

Figure 31:
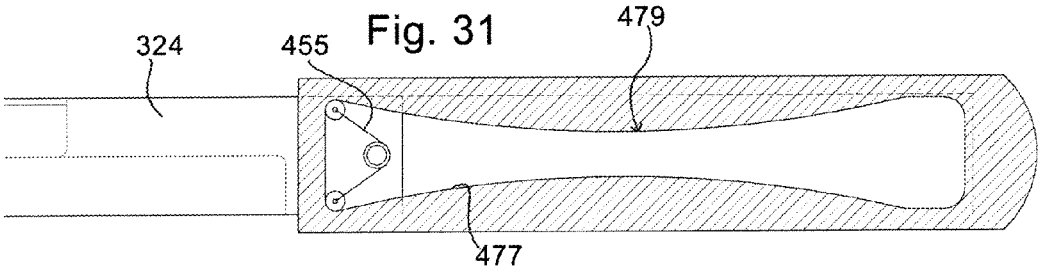
FIG. 31 shows the knife in an open orientation.
Figure 32:
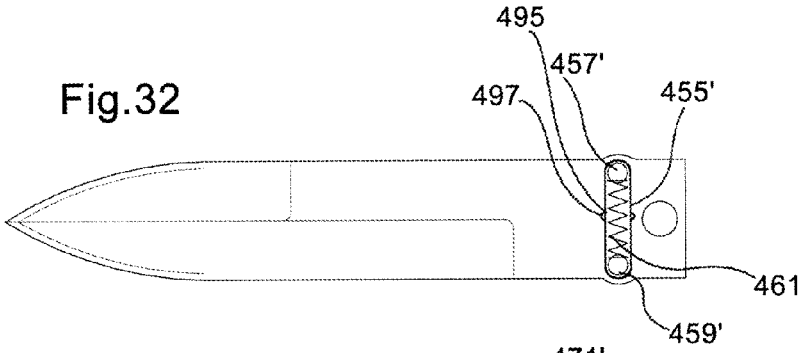
FIG. 32 shows another embodiment of a spring element.

Generally referring to FIGS. 29-31, it can be appreciated that the spring element 455 is shown where the cam engaging members 457 and 459 are configured to press against the first and second cam surfaces 471 and 473. The blade retention portions 475 of the cam surfaces are slanted longitudinally rearwardly so as to produce a longitudinally rearward thrust thereupon the blade. When a force is applied to the blade, as indicated by the vector 491, the spring element 455 passes through the equilibrium point generally indicated at 479. Of course, this point need not be in the central region of the handle in the longitudinal direction but could be positioned longitudinally rearwardly, for example near the region 481. In fact, the cam surfaces 471 and 473 can be of a variety of slopes in the longitudinal direction and need not be symmetrical or identical. Further, in the broader scope, a single cam surface can be utilized along with a single cam engaging member.

As shown in FIG. 31, it can be appreciated that the spring element has gone from a high stored energy state to a lower stored energy state, where the spring element 455 is in a fully extended position, and because of the longitudinally forward slanting surfaces of the blade propulsion portion 477 of the cam surfaces, the blade is sprung open once it is pushed past the equilibrium point 479.

FIGS. 32-36 show another embodiment wherein this form the spring element 455' comprises the cam engaging members 457' and 459'. The biasing member 461 in this form can be a helical spring, which, for example, can be positioned within a surface defining a slot 495 in the knife. In this form, the cam engaging members 457' and 459' could, for example, be ball bearings fit within the slot 495. The ball bearings could be initially fit through the open recess 497 and the laterally extending portions of the ball bearings can thereby extend latterly to engage the cam surfaces. Of course, the spring elements could be other types of members as well, such as small cylindrical members or the like.

Figure 33:
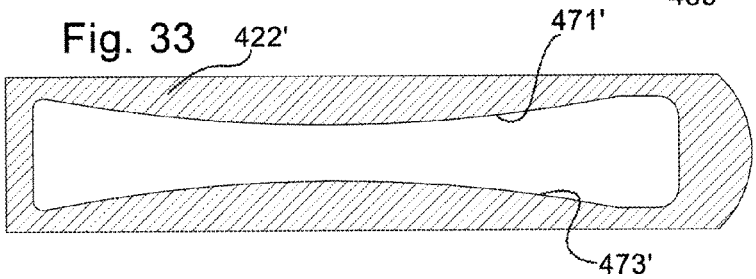
FIG. 33 shows a handle member, which in one form has first and second cam surfaces.
Figure 34:
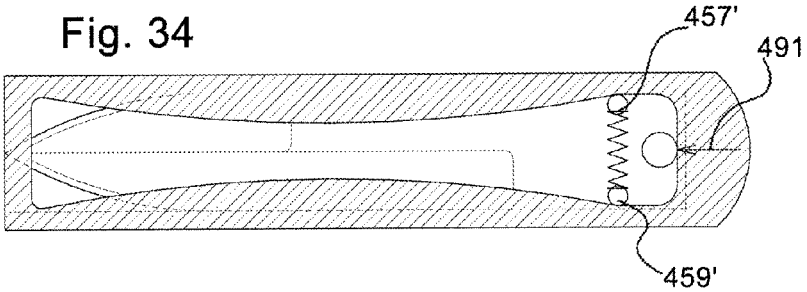
FIG. 34 shows the OTF knife in a closed orientation, where the blade is positioned longitudinally rearwardly.
Figure 35:
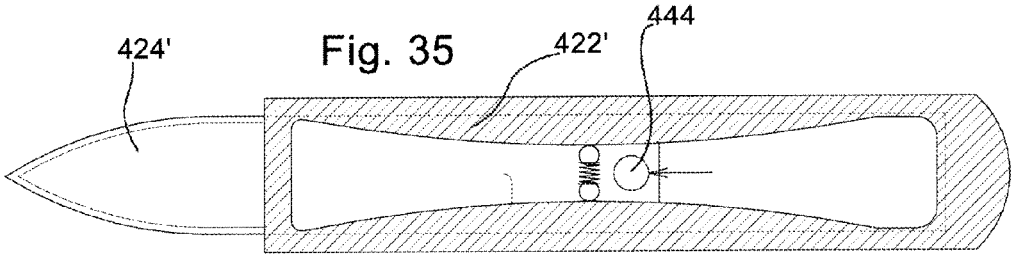
FIG. 35 shows the blade at an equilibrium point.
Figure 36:
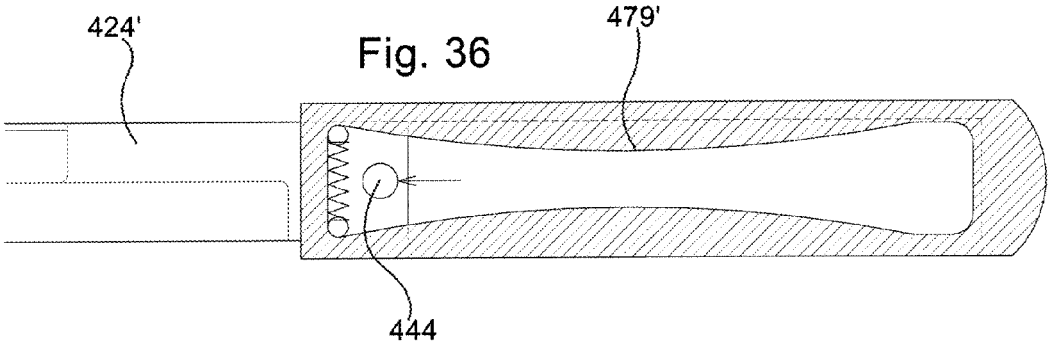
FIG. 36 shows the knife in an open orientation.

FIG. 33 shows a handle member 422' provided with cam surfaces 471' and 473'. As shown in FIG. 34, a force vector 491 can be applied to the blade which will be of sufficient force to counteract the separating forces between the cam engagement members 457' and 459'. The thumb engagement portion 444 can extend in the lateral direction and could, for example, be gnarled for good frictional engagement of any finger or other external device to apply force to the blade to bias it open. As shown in FIG. 36, the blade 424' is in an open orientation. Of course it should be noted that various types of locking mechanisms can further be employed to lock the blade open. These locking mechanisms could be integrated with the thumb engagement portion 444 so that when this blade interface portion is pressed in the lateral direction and longitudinally rearwardly, the blade will unlock and be repositioned longitudinally rearwardly. It should be noted that after the blade travels in the longitudinal rearward direction past the equilibrium point 479', the blade will "snap back" where the return force upon the blade exceeds the longitudinal forward force on the blade (whereas with the embodiments in FIGS. 22-36 the longitudinal forward force is nonexistent rearward of the equilibrium point).

Figure 37:
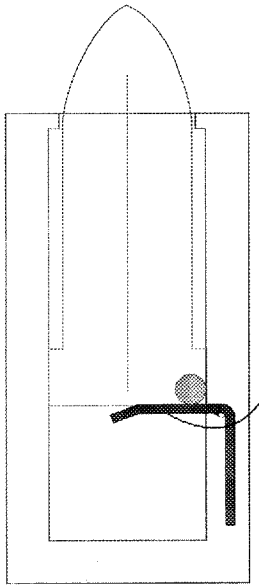
FIG. 37 shows another embodiment of an OTF knife, having a spring member that acts upon the blade to bias the blade open and retain the blade.
Figure 38:
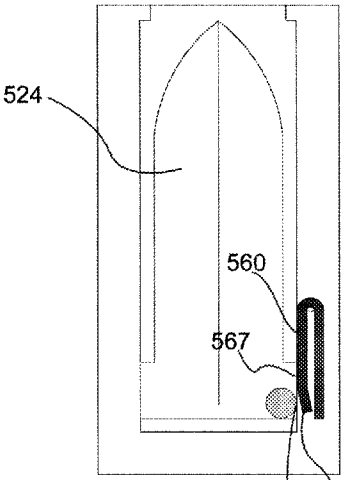
FIG. 38 shows the blade in a retained orientation.

As shown in FIG. 37, there is an embodiment of an OTF knife 520 wherein this form, the spring system 541 comprises a spring member 560. As shown in FIG. 38, the spring member 560 is in a high stored energy state. A longitudinal rearward force is applied thereto the blade 524 by way of the angle of the spring at the location 565. The entire biasing member 567 can be slightly bent longitudinally rearwardly in one form. The end region 569 can have a slight bend in it, having a longitudinally rearward slope so the blade is biased longitudinally rearwardly when in a closed position.

Figure 39:
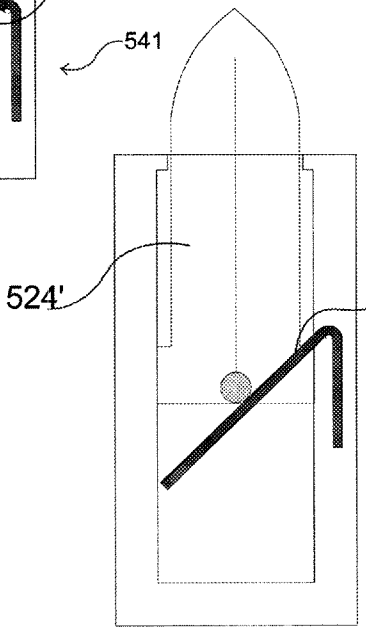
FIG. 39 shows another embodiment of an OTF knife.
Figure 40:
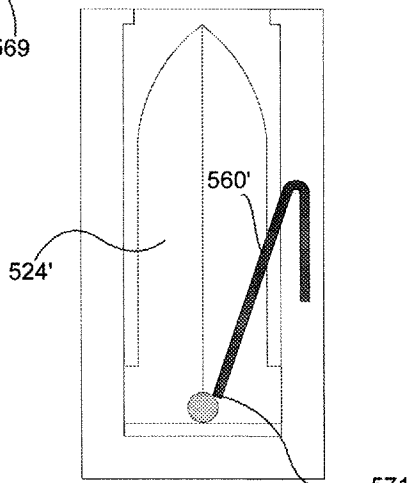
FIG. 40 shows another embodiment of an OTF knife with a knife in a retracted position.

Now referring to FIGS. 39-40, there is shown another embodiment where the member 560' is shown and configured to supply a force to the blade 524'. As shown in FIG. 40, in one form the blade 524' can be retained by way of engaging the tip region 571 of the spring member 560'. Basically, FIG. 40 shows another method of applying a longitudinally rearward force to the blade when the blade is in a retracted orientation.

Figure 44:
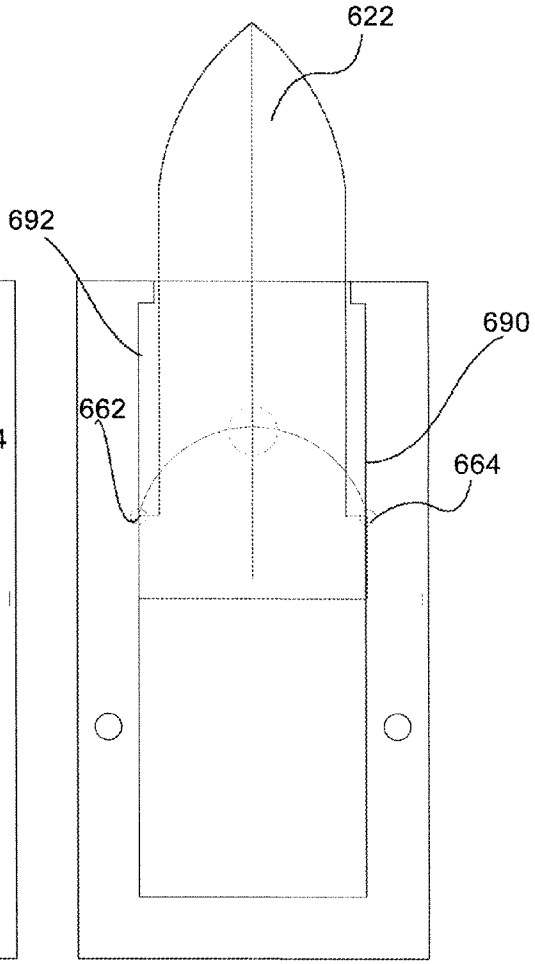
FIGS. 41-44 show a progressive view of another embodiment.
Figure 43:
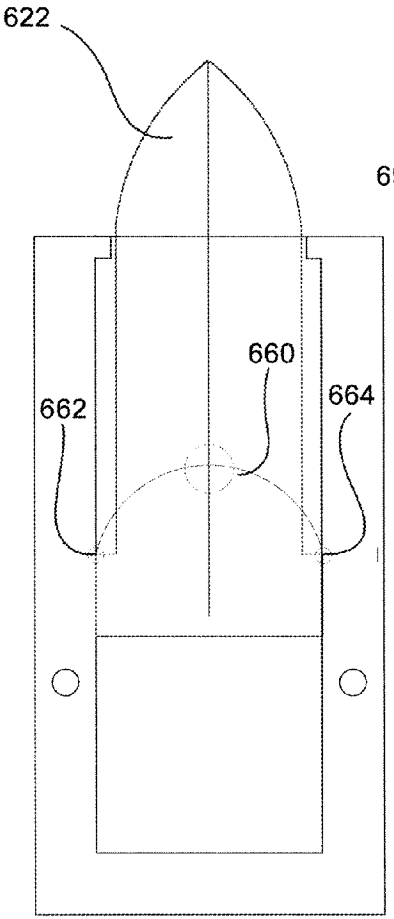
Figure 42:
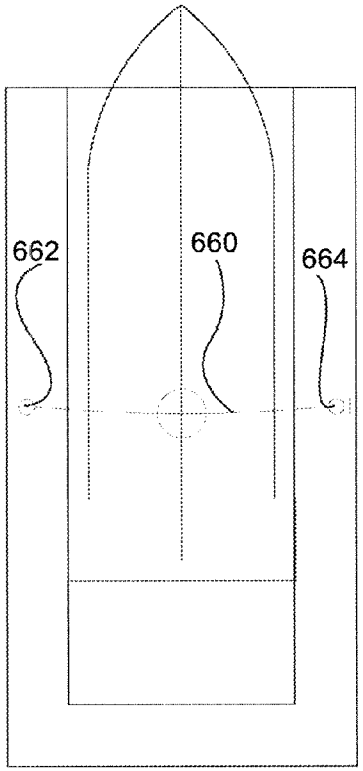
Figure 41:
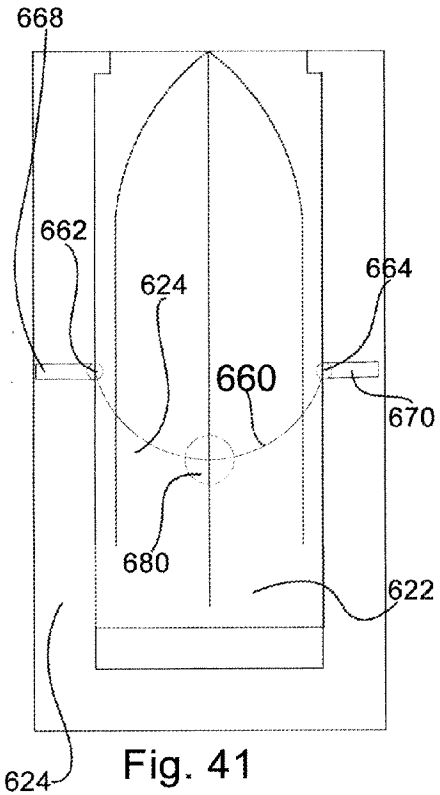

Now referring to FIG. 41, there is shown an embodiment where a spring member 660 is provided, where the spring member has the ends 662 and 664 that are configured to engage receiving locations 668 and 670 of the handle 624. The blade 622 has a connection location 680 that is configured to be mounted to the spring member 660. In one form, the connection location 680 allows for the spring member to rotate therein. As shown in FIG. 42, the spring member 660 is in a stored energy state where the natural location of the spring member is to be in a arced state. Now referring to FIG. 43, it can be appreciated that the spring member 660 is now imparting energy upon the blade 622 where the ends 662 and 664 now retract transversely inwardly. Now referring to FIG. 44, it can be seen that the blade 622 will continue longitudinally forwardly, where, for example, in one form longitudinal slots are provided at 690 and 692 to allow the end portion 662 and 664 to travel therein for allowing the blade to extend into a fully extended state.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. An out-the-front-style knife comprising:

a blade assembly comprising a blade;

a cross guard assembly;

wherein the blade having a first void to receive a first pin and a second void to receive a second pin, wherein the first pin and second pin provide a pivot point for a first cross guard and a second cross guard and the first void and second void are near a base of the blade;

a handle assembly, the handle assembly including an interior surface forming an interior chamber, wherein the blade repositions from a closed position in the interior chamber to an open position by sliding in a longitudinally forward direction with respect to the handle assembly, the handle assembly including a plurality of extension channels to receive a first extension of the first cross guard and a second extension of the second cross guard and the extension channels are angled near the longitudinally forward end of the handle assembly;

wherein the cross guard assembly comprises the first cross guard pivotally attached to the blade with the first pin extending through the first void and the second cross guard pivotally attached to the blade with the second pin extending through the second void;

wherein the first and second cross guards are configured to be pivoted toward the transverse center of the handle assembly as the blade is retracted from the open position to the closed position; and wherein the first extension and the second extension of the first and second cross guards engage the extension channels formed within the handle assembly and are contained substantially within the handle assembly in the closed position, wherein the first extension and the second extension coordinate with the angled end of the extension channels near the longitudinally forward end of the handle assembly to rotate the first cross guard and the second cross guard about the first pin and second pin to the open position.

2. The out-the-front-style knife of claim 1 further comprising a plurality of extension springs, each extension spring having a first end and a second end wherein the first end is coupled to the blade and the second end is coupled to the first or second cross guard and tensioned to rotate the first and second cross guard to the extended position when the blade is substantially extended.

3. The out-the-front-style knife of claim 1 wherein the first and second cross guards are contained within a blade channel formed within the interior chamber of the handle assembly of the knife when the knife is in the sheathed position, wherein the blade channel further contains the blade of the knife when the knife is in the sheathed position.

4. The out-the-front-style knife of claim 1 wherein the blade assembly comprises a stiletto-style blade wherein at least a portion of the blade is sharpened on both transverse edges.

5. The out-the-front-style knife of claim 1 wherein the blade further comprises a first lateral side and a second lateral side and both the first and second cross guard extend from the first lateral side of the blade.

6. The out-the-front-style knife of claim 5 further comprising a third and a fourth cross guard extending from the second lateral side of the blade.

7. The out-the-front-style knife of claim 6 wherein the first and the third cross guards are interconnected and move substantially together and the second and the fourth cross guards are interconnected and move substantially together.

8. The out-the-front-style knife of claim 5 wherein the first and second cross guards are interconnected by way of a plurality of interdigitating members.

* * * * *